US010926558B2

(12) United States Patent
Eiyama

(10) Patent No.: US 10,926,558 B2
(45) Date of Patent: Feb. 23, 2021

(54) PRINT APPARATUS

(71) Applicant: CANON KABUSHIKI KAISHA, Tokyo (JP)

(72) Inventor: Masato Eiyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/599,845

(22) Filed: Oct. 11, 2019

(65) Prior Publication Data

US 2020/0130386 A1 Apr. 30, 2020

(30) Foreign Application Priority Data

Oct. 29, 2018 (JP) ..... JP2018-203276

(51) Int. Cl.

| | |
|---|---|
| ***B41J 11/00*** | (2006.01) |
| ***B41J 15/02*** | (2006.01) |
| ***B41J 15/04*** | (2006.01) |
| ***B41J 13/00*** | (2006.01) |

(52) U.S. Cl.

CPC ..... *B41J 11/0095* (2013.01); *B41J 11/006* (2013.01); *B41J 13/0009* (2013.01); *B41J 15/02* (2013.01); *B41J 15/04* (2013.01)

(58) Field of Classification Search

CPC ..... B41J 11/006; B41J 11/0095; B41J 15/02; B41J 15/04

See application file for complete search history.

(56) References Cited

U.S. PATENT DOCUMENTS

2002/0154205 A1* 10/2002 Kaya ..... G03G 15/652 347/177
2016/0137448 A1* 5/2016 Sumioka ..... B65H 16/028 226/11
2018/0257408 A1 9/2018 Eiyama

FOREIGN PATENT DOCUMENTS

JP 2013158973 A * 8/2013

* cited by examiner

*Primary Examiner* — Matthew Luu
*Assistant Examiner* — Kendrick X Liu
(74) *Attorney, Agent, or Firm* — Canon U.S.A., Inc. I.P. Division

(57) ABSTRACT

A print apparatus includes a holding unit to hold a roll sheet obtained by winding a sheet, a driving unit, a separation flapper, a pressure contact roller, a print unit, a displacement sensor, and a control unit. The driving unit rotates the held roll sheet. The separation flapper follows a roll sheet surface to separate the sheet from the roll sheet. The pressure contact roller comes into pressure contact with the roll sheet surface. The print unit prints an image on the sheet supplied by rotating the roll sheet in pressure contact with the pressure contact roller in a forward direction. The displacement sensor detects a separation flapper displacement amount according to separation flapper rotation when the sheet is supplied to the print unit after a roll sheet front end is detected. The control unit stops the roll sheet rotation when the amount of displacement exceeds a threshold.

13 Claims, 17 Drawing Sheets

PRINT APPARATUS

BACKGROUND

Field

The present disclosure relates to a print apparatus for printing an image on a sheet pulled out of a roll sheet.

Description of the Related Art

United States Patent Application Publication No. 2018-0257408 discusses a print apparatus that rotates a roll sheet obtained by winding a sheet, thereby pulls out the sheet, and prints an image on the sheet. The print apparatus can automatically supply the sheet by detecting the front end of the sheet in the roll sheet. When detecting the front end of the sheet, the print apparatus rotates the roll sheet in a direction opposite to the conveying direction of the sheet. If the front end of the sheet separates from the roll sheet and comes close to a distance sensor, the output of the distance sensor changes. By grasping this change, it is possible to detect the front end of the sheet. If detecting the front end of the sheet, the print apparatus rotates the roll sheet in a forward direction, thereby supplying the sheet to a print unit.

According to United States Patent Application Publication No. 2018-0257408, however, in a case where a sheet having high stiffness or a sheet strongly curled due to its small winding diameter is supplied, the supplied sheet may jam in a conveying path. If the sheet continues to be supplied in this situation, the sheet becomes folded and unusable.

SUMMARY

To automatically supply a sheet in a print apparatus, it is desirable to detect not only the front end of the sheet but also an abnormal state of the sheet when supplied. The present disclosure is directed to providing a print apparatus that monitors the state of a roll sheet and thereby can normally automatically supply a sheet. According to an aspect of the present disclosure, a print apparatus includes a holding unit configured to hold a roll sheet obtained by winding a sheet, a driving unit configured to rotate the roll sheet held by the holding unit, a separation flapper configured to follow a surface of the roll sheet to separate the sheet from the roll sheet, a pressure contact roller configured to come into pressure contact with the surface of the roll sheet, a print unit configured to print an image on the sheet supplied by rotating the roll sheet in pressure contact with the pressure contact roller in a forward direction, a displacement sensor configured to detect an amount of displacement of the separation flapper according to rotation of the separation flapper, a detection unit configured to detect the amount of displacement detected by the displacement sensor when the sheet is supplied to the print unit after a front end of the roll sheet is detected, and a control unit configured to stop the rotation of the roll sheet in a case where the amount of displacement exceeds a threshold.

Further features of the present disclosure will become apparent from the following description of exemplary embodiments with reference to the attached drawings.

DESCRIPTION OF THE EMBODIMENTS

Exemplary embodiments of the present disclosure will be described with reference to the drawings.

(Print Apparatus)

Figure 1:
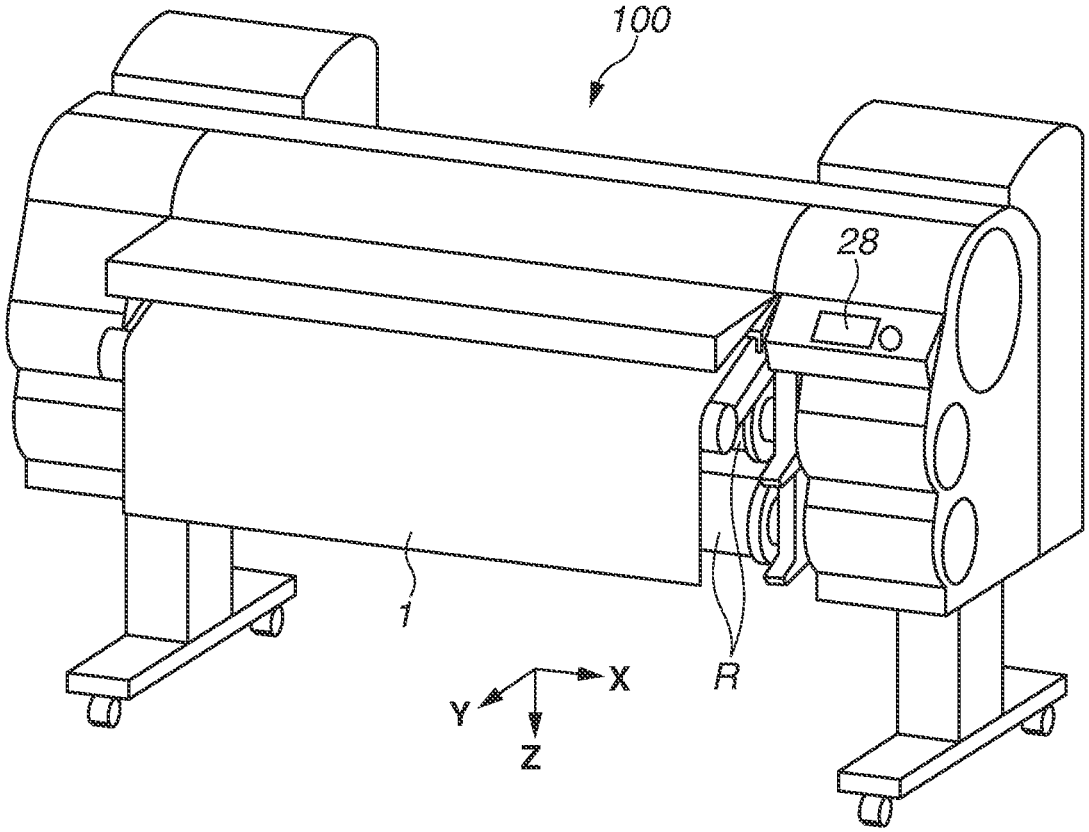
FIG. 1 is a perspective view illustrating an external appearance of an entirety of a print apparatus.
Figure 2:
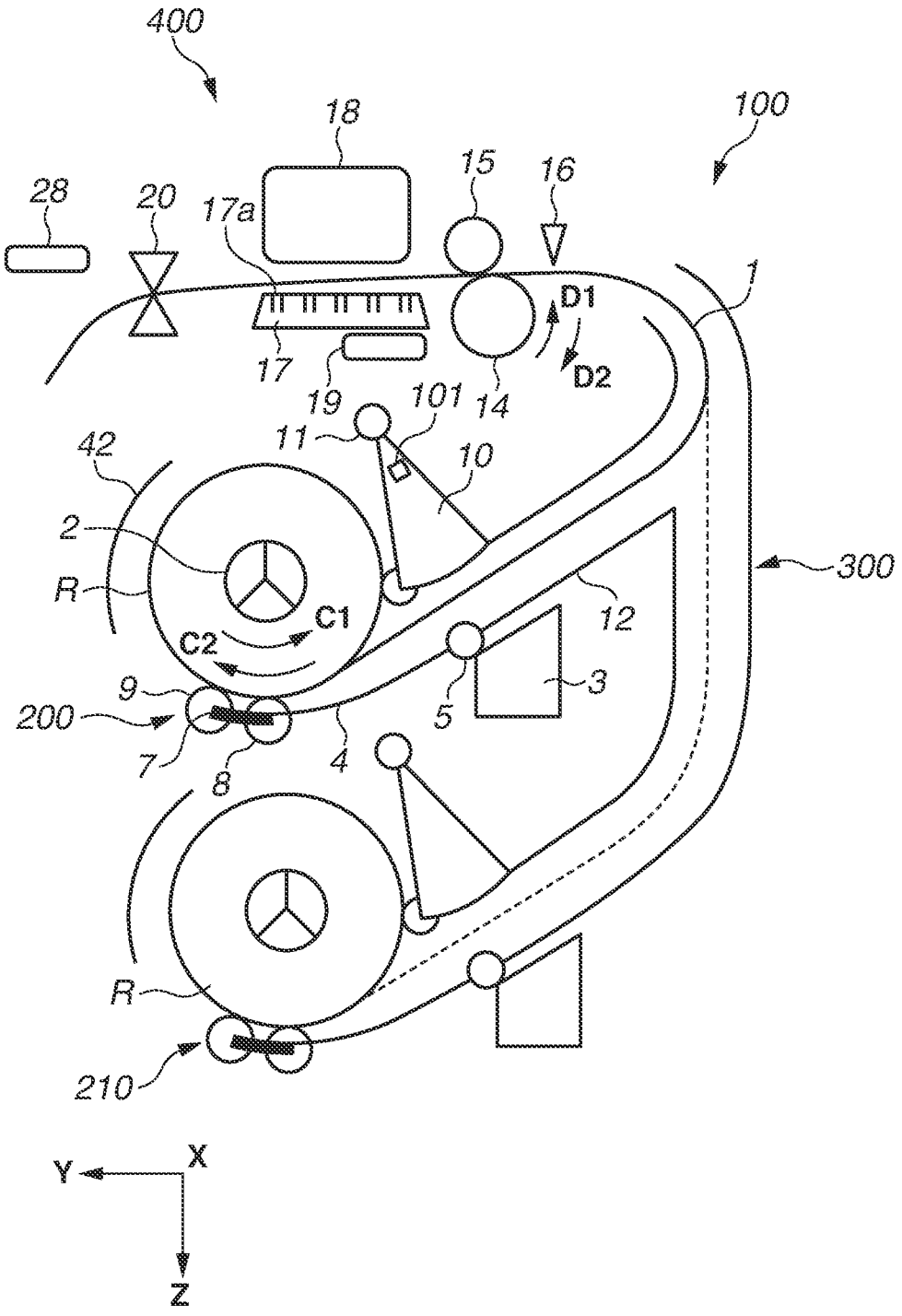
FIG. 2 is a schematic diagram of a main part of the print apparatus.
Figure 3:
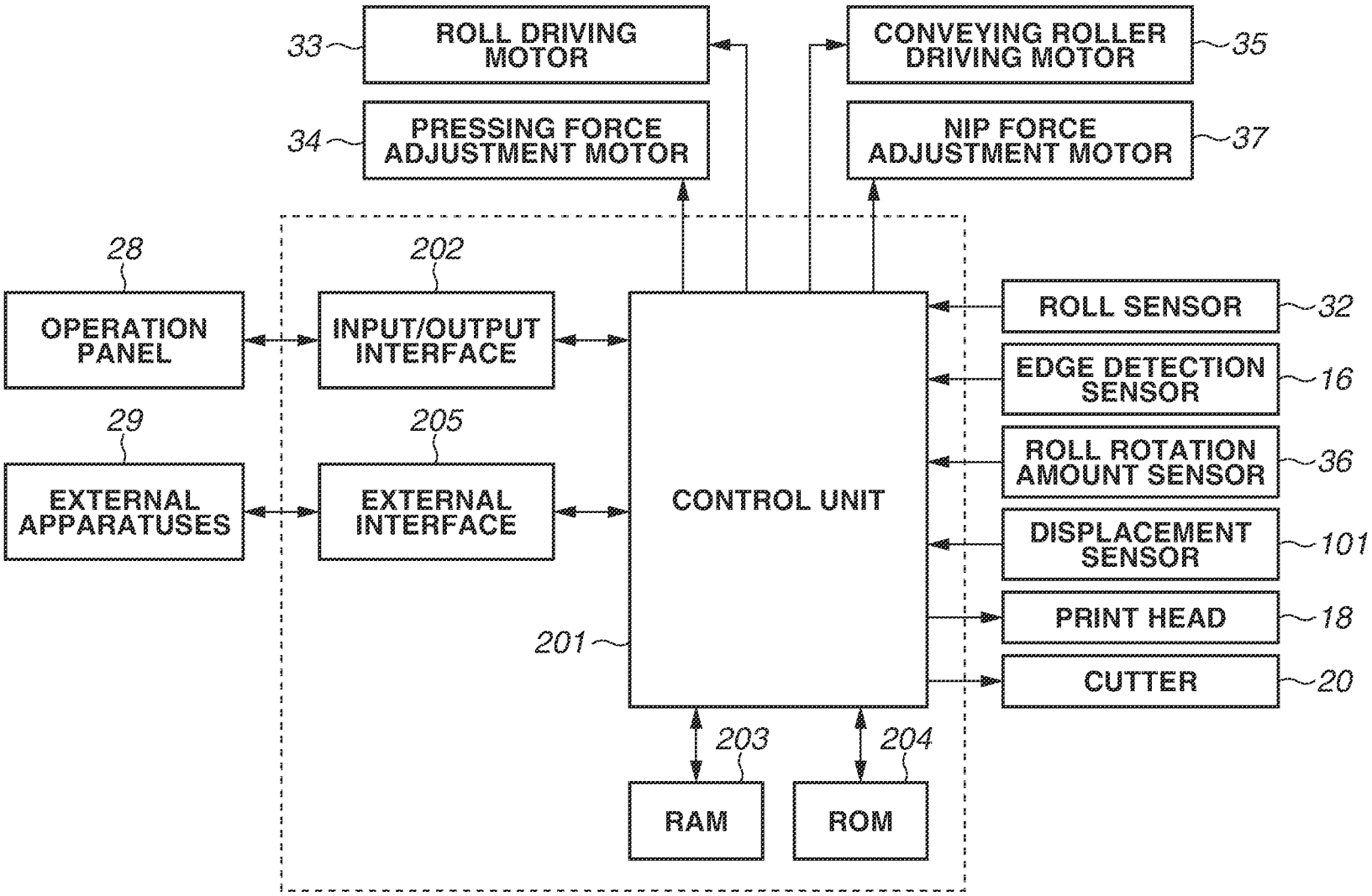
FIG. 3 is a block diagram of a control system of the print apparatus.

The configuration of a print apparatus according to a first exemplary embodiment of the present disclosure is to be described with reference to FIGS. 1 to 3. FIG. 1 is a perspective view illustrating the external appearance of the entirety of the print apparatus. FIG. 2 is a schematic diagram of a main part of the print apparatus. FIG. 3 is a block diagram of a control system of the print apparatus.

A print apparatus 100 according to the present disclosure includes a sheet supply device 200 that supplies a sheet as a print medium, a conveying unit 300 that conveys the sheet, and a print unit 400 that discharges ink to the conveyed sheet to print an image on the sheet.

The print apparatus 100 includes sheet supply devices (200 and 210) that supply a roll sheet R obtained by winding a sheet into a roll from an upper stage and a lower stage. In the case of the sheet supply device 200, a sheet 1 pulled out of the roll sheet R is conveyed by the conveying unit 300 along a conveying path to the print unit 400, which prints an image. A user can give instructions to make initial settings, perform various operations, and switch between online and offline states, using various switches included in an operation panel 28. A coordinate system is defined such that the width direction of the roll sheet R is an X-axis, the direction in which the sheet 1 is conveyed is a Y-axis, and the direction of gravity is a Z-axis.

The sheet supply device 200 includes a spool member 2, a spool holder (not illustrated), an arm member 4, a swinging member 7, a separation flapper 10, and a displacement sensor 101. The roll sheet R is held by a holding unit including the spool member 2 and the spool holder inserted into a hollow hole portion of the holding unit. A roll sensor 32 detects the spool member 2 of the roll sheet R, whereby it is possible to detect that the roll sheet R is set in the holding unit. The arm member 4 presses pressure contact rollers 8 and 9 provided in the swinging member 7 against the roll sheet R and also guides the sheet 1. The pressing force on the roll sheet R can be adjusted by a pressing force adjustment motor 34. The separation flapper 10 separates the sheet 1 from the roll sheet R and guides the separated sheet 1 on a lower surface 10*c* of the separation flapper 10. The arm member 4 and the lower surface 10*c* of the separation flapper 10 form the supply path of the sheet 1.

The spool member 2 can rotate in a forward direction (a direction C1) and a backward direction (a direction C2) by a roll driving motor 33. A roll rotation amount sensor 36 can detect the rotational angle of the spool member 2, i.e., the rotational angle of the roll sheet R. The roll rotation amount sensor 36 is a rotary encoder that outputs as many pulses as a number according to the rotational angle of the roll sheet R. If the roll driving motor 33 rotates the spool member 2 in the forward direction, the roll sheet R rotates accordingly. The sheet 1 pulled out of the roll sheet R is supplied to the conveying unit 300 through the supply path. A cover 42 prevents the sheet 1 on which an image is printed from entering the sheet supply device 200.

The conveying unit 300 includes a conveying guide 12, an edge detection sensor 16, a conveying roller 14, and a pinch roller 15. The conveying guide 12 provided in the conveying unit 300 guides the front and back surfaces of the pulled-out sheet 1. The conveying roller 14 rotates in a forward direction (a direction D1) and a backward direction (a direction D2) by a conveying roller driving motor 35. The pinch roller 15 can be driven to rotate according to the rotation of the conveying roller 14. The conveying roller 14 and the pinch roller 15 nip the sheet 1 and convey the sheet 1 to the print unit 400. The conveying speed of the conveying roller 14 is set to be greater than the speed of pulling out the sheet 1 by the rotation of the spool member 2. The edge detection sensor 16 is a sensor that optically detects the front or rear end of the sheet 1 on an upstream side of the conveying roller 14. For example, the edge detection sensor 16 detects light reflected from the front end of the sheet 1 and thereby can detect the front end of the sheet 1.

The print unit 400 includes a print head 18, a platen 17, a suction fan 19, and a scanning mechanism (not illustrated). The print unit 400 causes the back surface of the sheet 1 to stick to the platen 17 through a suction hole 17*a* by negative pressure generated by the suction fan 19. Consequently, the orientation of the sheet 1 along the platen 17 can be regulated. The inkjet print head 18 discharges ink to print an image on the sheet 1 supported by the platen 17. An electrothermal conversion element (a heater) is used to discharge the ink. The print method is a serial scan method. In this method, an image is sequentially printed on the sheet 1 by alternately conveying the sheet 1 (the Y-direction) and moving the print head 18 in a direction (the X-direction) intersecting the Y-direction. If the print is completed, the sheet 1 on which the image is printed is cut by a cutter 20.

According to a control program stored in a read-only memory (ROM) 204, a control unit 201 controls the print apparatus 100 including the sheet supply device 200, the conveying unit 300, and the print unit 400. The type and the width of the sheet 1 and various pieces of setting information are input to the control unit 201 from the operation panel 28 via an input/output interface 202. The control unit 201 is connected to various external apparatuses 29 including a host apparatus such as a personal computer via an external interface 205, and transmits and receives various pieces of information such as print data to and from the external apparatuses 29. The control unit 201 writes and reads information regarding the sheet 1 to and from a random-access memory (RAM) 203.

The print apparatus is not limited to a configuration in which the print apparatus includes two sheet supply devices corresponding to two roll sheets. Alternatively, the print apparatus may include a single sheet supply device or three or more sheet supply devices. The print apparatus only needs to be configured to print an image on a sheet supplied from a sheet supply device, and is not limited to an inkjet print apparatus. Further, the print method may be a full-line method for successively conveying sheets to a position opposed to a long print head and printing images on the sheets.

(Sheet Supply Device)

Figure 4A:
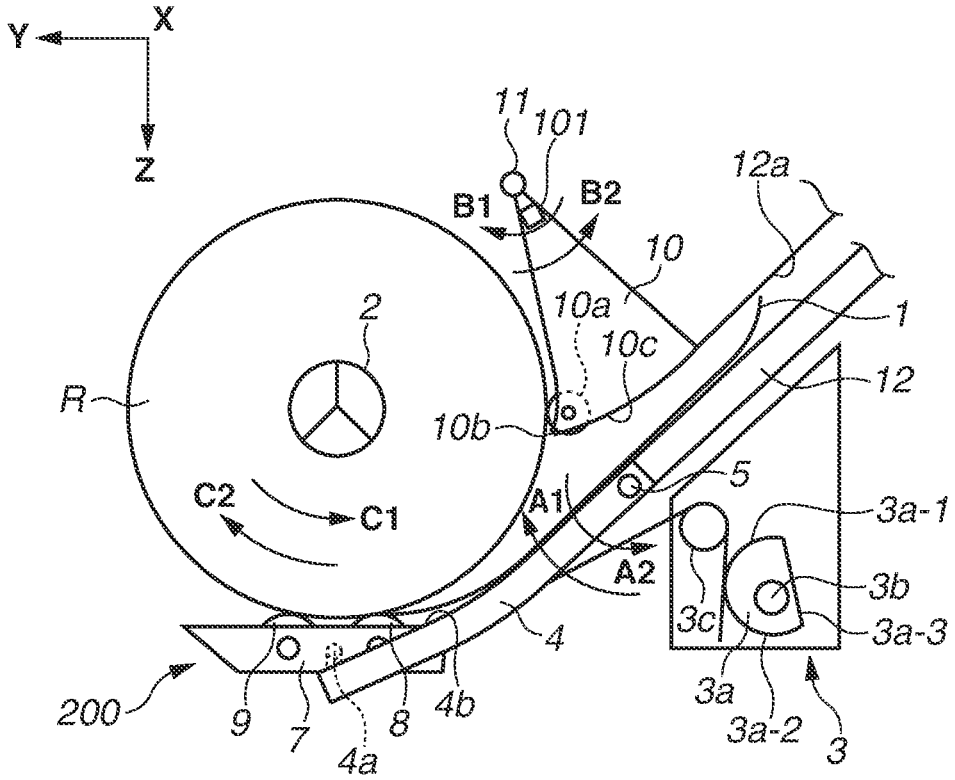
FIGS. 4A and 4B are diagrams illustrating a sheet supply device.

The sheet supply device 200 is described in detail with reference to FIGS. 4A and 4B. The conveying guide 12 includes the arm member 4 that is rotatable in directions A1 and A2 about an arm rotating shaft 5. The arm member 4 includes a guide portion 4*b* that guides the lower surface of the sheet 1 pulled out of the roll sheet R. The arm member 4 rotates using a rotating cam 3*a* of an arm driving unit 3. A helical coil spring 3*c* is provided between the arm member 4 and the rotating cam 3*a*. The helical coil spring 3*c* presses the arm member 4 in the direction of the arrow A1. The rotating cam 3*a* is rotated by the pressing force adjustment motor 34, and the pressing force on the arm member 4 is changed according to the rotational position of the rotating cam 3*a*. This pressing state includes a pressing state with a relatively great force (a strong nip state), a pressing state with a relatively small force (a weak nip state), and the release of the pressing force.

The swinging member 7 is swingably provided in the arm member 4. The first and second pressure contact rollers 8 and 9 are rotatably provided in the swinging member 7 in the outer circumferential direction of the roll sheet R. The pressure contact rollers 8 and 9 are moved according to the outer diameter of the roll sheet R by the pressing force in the direction A1 and come into pressure contact with the surface of the roll sheet R from below in the direction of gravity. The rotating cam 3*a* is rotated according to a change in the outer diameter of the roll sheet R so that the pressing force on the arm member 4 can be maintained in a predetermined range. The pressure contact rollers 8 and 9 are brought into pressure contact with the surface of the roll sheet R so as to prevent the sheet 1 from getting loose.

Figure 4B:
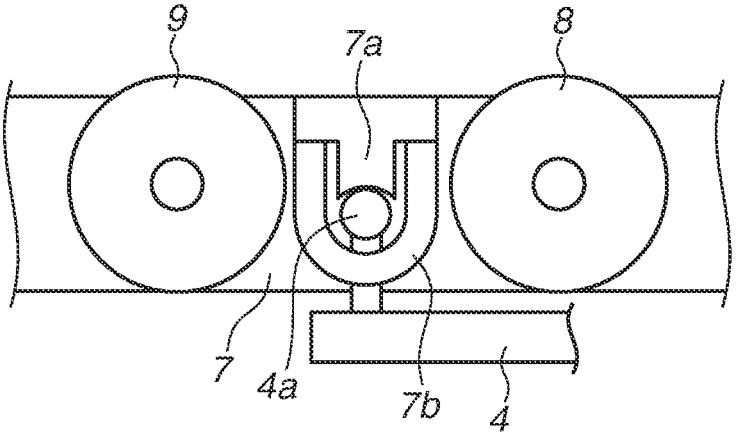

As illustrated in FIG. 4B, a bearing portion 7*a* and a shaft retaining portion 7*b* are provided in the swinging member 7. The bearing portion 7*a* is provided to support the position of the center of gravity of the swinging member 7. For this reason, the orientation of the swinging member 7 is stabilized by a rotating shaft 4*a* in each of the X-axis direction, the Y-axis direction, and the Z-axis direction. The rotating shaft 4*a* has a play, and therefore, the swinging member 7 can be displaced along the surface of the roll sheet R in an allowable range in the X-axis direction. Such an equalization mechanism allows changes in the orientations of the first and second pressure contact rollers 8 and 9 relative to the surface of the roll sheet R. This results in maintaining the maximum contact area between the sheet 1 and the first and second pressure contact rollers 8 and 9 and equalizing the pressing force on the sheet 1. In this way, variations in the force to supply the sheet 1 can be reduced.

The separation flapper 10 can rotate in the directions of arrows B1 and B2 about a separation flapper rotating shaft 11 above the arm member 4 and can lightly come into contact with the surface of the roll sheet R by the weight of the separation flapper 10 itself. For this reason, the separation flapper 10 can come into contact with the surface of the roll sheet R according to a change in the outer diameter of the roll sheet R. A driven roller 10*a* is rotatably provided in a portion of the separation flapper 10 in contact with the roll sheet R so as to reduce the influence of friction on the sheet 1. A separation portion 10*b* at the extremity of the separation flapper 10 is formed at a position as close to the surface of the roll sheet R as possible to facilitate the separation of the front end of the sheet 1 from the roll sheet R. The displacement sensor 101 is provided in the separation flapper 10 and can detect the displacement of the separation flapper 10.

The sheet 1 is pulled out by rotating the roll sheet R forward while bringing the pressure contact rollers 8 and 9 into pressure contact with the roll sheet R. The lower surface of the sheet 1 is guided by the guide portion 4*b* in an upper portion of the arm member 4. The pulled-out sheet 1 is supplied through the supply path formed between the separation flapper 10 and the arm member 4. As described above, using the weight of the sheet 1 itself, it is possible to smoothly supply the sheet 1. The arm member 4 and the separation flapper 10 rotate according to a change in the outer diameter of the roll sheet R. In this way, a supply path having an almost constant height is formed. As a result, even if the outer diameter of the roll sheet R changes, it is possible to certainly supply the sheet 1 from the roll sheet R.

Figure 5A:
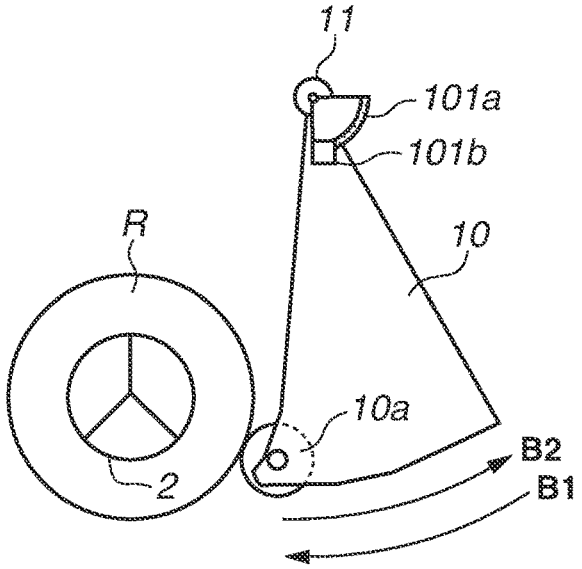
FIGS. 5A, 5B, and 5C are diagrams illustrating detection of an amount of displacement by a displacement sensor using an encoder.
Figure 5B:
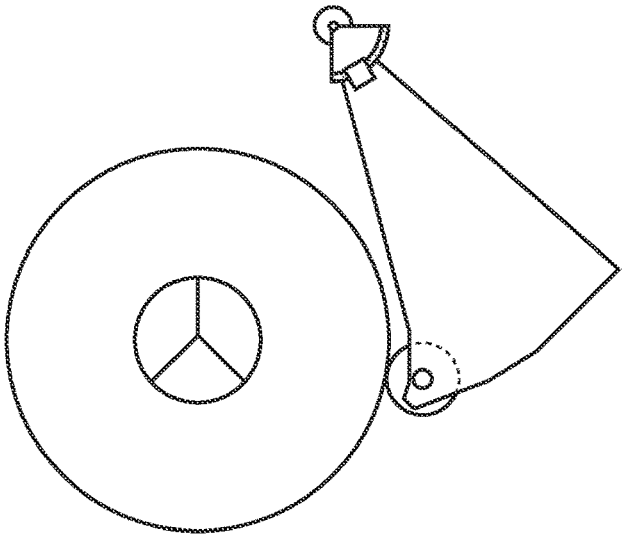
Figure 5C:
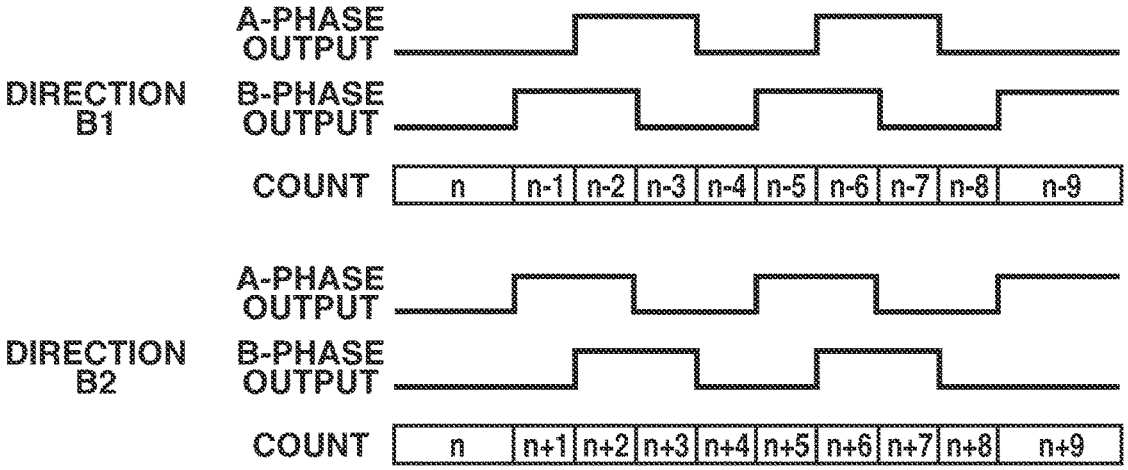

A method for detecting the amount of displacement by the displacement sensor 101 using an encoder is to be described with reference to FIGS. 5A, 5B, and 5C. FIGS. 5A and 5B are diagrams illustrating the states of the separation flapper 10 and the displacement sensor 101. The displacement sensor 101 is an encoder including a code wheel 101*a* and an optical sensor 101*b*. The code wheel 101*a* is placed coaxially with the separation flapper rotating shaft 11 and fixed regardless of the rotation of the separation flapper 10. Slits are formed in the code wheel 101*a* at regular intervals radially around the separation flapper rotating shaft 11. The optical sensor 101*b* is a transmissive optical sensor and includes a light-emitting unit and a light-receiving unit with the code wheel 101*a* therebetween. The optical sensor 101*b* is fixed to the separation flapper 10. For this reason, if the separation flapper 10 rotates about the separation flapper rotating shaft 11, the optical sensor 101*b* crosses the slits of the code wheel 101*a*. The encoder can detect the amount of displacement of the separation flapper 10 based on a pulse count value obtained by counting the number of slits crossed by the optical sensor 101*b*.

The encoder has a two-phase output including an A-phase and a B-phase and can also measure the direction in which the separation flapper 10 rotates. That is, if the separation flapper 10 comes close to the roll sheet R (in the direction B1), the pulses of the output of the encoder change through the B-phase and the A-phase in this order. In this case, the pulse count value is counted down. Conversely, if the separation flapper 10 goes away from the roll sheet R (in the direction B2), the pulses of the output of the encoder change through the A-phase and the B-phase in this order. In this case, the pulse count value is counted up. In the present exemplary embodiment, to deal with a case where the radius of the roll sheet R is 35 mm to 110 mm, the angle of the separation flapper 10 changes from 20 degrees to 70 degrees. The angular resolution of the encoder is 0.01 degrees/count. In this case, if the radius of the roll sheet R changes by 1.5 mm, the angle of the separation flapper 10 changes by 1 degree. In a case where the spool member 2 is not attached, the angle of the separation flapper 10 is 0 degrees. Alternatively, a configuration may be employed in which the optical sensor 101*b* is fixed and the code wheel 101*a* is movable. Yet alternatively, a reflective optical sensor may be used.

(Automatic Loading of Sheet)

Figure 6:
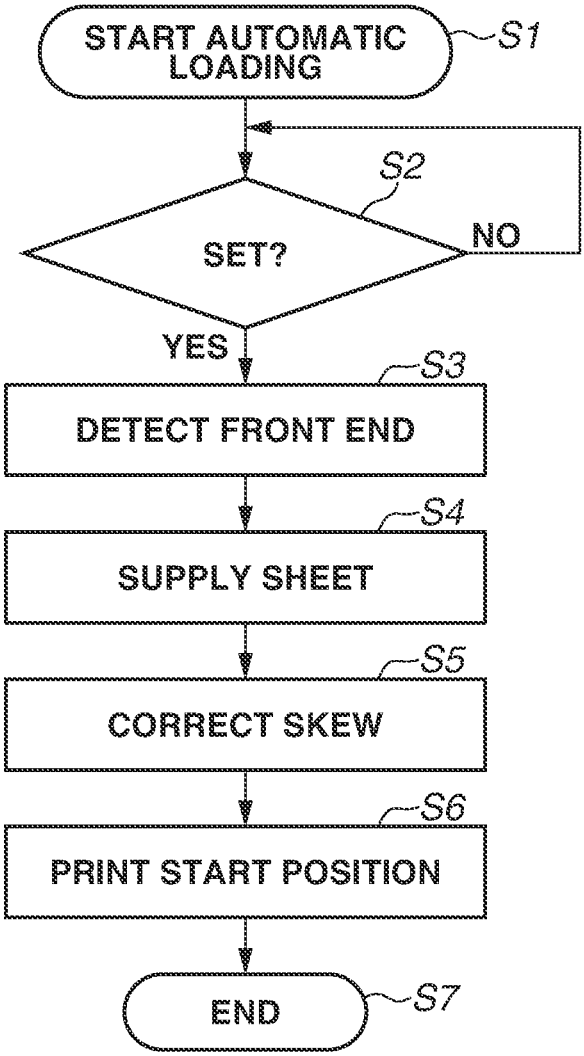
FIG. 6 is a flowchart of automatic loading of a sheet.

The automatic loading of the sheet is the function of detecting the front end of the sheet from the roll sheet and supplying the sheet to a predetermined position in the conveying unit when a user sets the roll sheet in the apparatus. FIG. 6 illustrates a flowchart of the automatic loading. The "roll sheet" refers to the state of a roll obtained by winding a sheet. The "sheet" refers to the state of a single sheet.

In step S1, the automatic loading of the sheet 1 is started. The user sets the roll sheet R in the sheet supply device 200 and gives an instruction to start the automatic loading, using the operation panel 28 or the external apparatuses 29.

In step S2, it is detected that the roll sheet R is set in the holding unit. The control unit 201 causes the roll sensor 32 to detect the spool member 2, thereby confirming that the roll sheet R is set. At this time, the arm member 4 is in the weak nip state.

In step S3, the front end of the sheet 1 in the roll sheet R is detected. First, the control unit 201 switches the arm member 4 to the strong nip state. Then, a front end detection operation for detecting the front end of the sheet 1 (FIG. 9) is performed.

Figure 12:
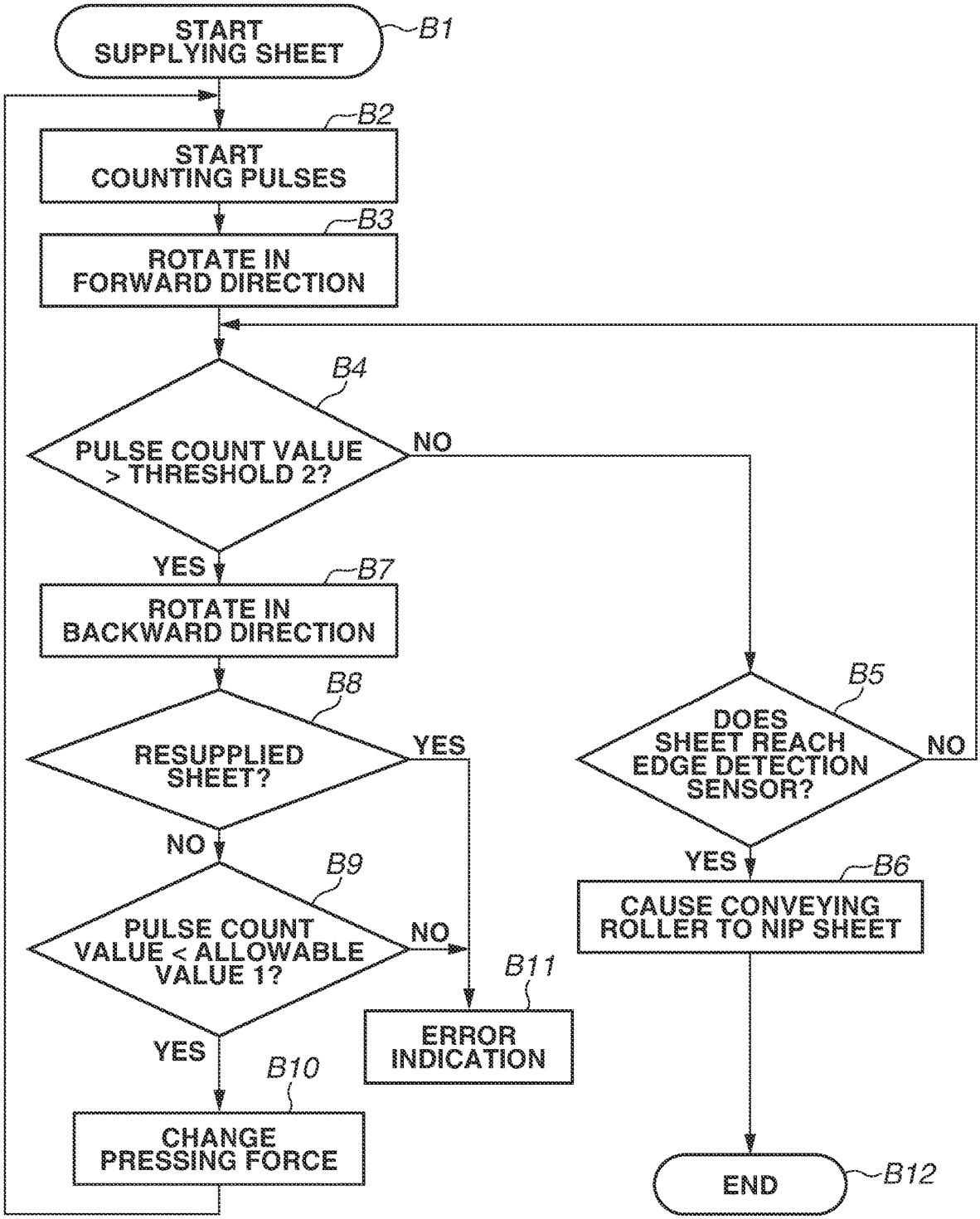
FIG. 12 is a flowchart of the supply of the sheet.

In step S4, the sheet 1 is supplied to the conveying unit 300. Since the front end of the sheet 1 in the roll sheet R is detected, the control unit 201 performs a sheet supply operation (FIG. 12) to rotate the roll sheet R in the forward direction and supply the sheet 1 to the conveying unit 300.

In step S5, the correction of the skew of the sheet 1 is started. First, the control unit 201 causes the conveying roller 14 to convey the sheet 1 by a predetermined amount, and measures the amount of skew at this time using a sensor of the print head 18. If the amount of skew is greater than an allowable value, the control unit 201 causes the conveying roller 14 and the roll sheet R to cooperate to repeat rotation in the forward direction and rotation in the backward direction while applying back tension to the sheet 1. By such an operation, it is possible to correct the skew of the sheet 1.

In step S6, the sheet 1 is conveyed to a print start position. Upon finishing correcting the skew, the control unit 201 rotates the conveying roller 14 in the forward direction to convey the front end of the sheet 1 to the initial position of a print operation.

In step S7, the automatic loading ends. If an instruction to perform print is given, the sheet 1 can be appropriately conveyed to the print unit 400 by the conveying roller 14.

(Front End Detection Process)

A front end detection process (step S3) in the automatic loading is described in detail With reference to FIGS. 7A, 7B, 7C, 8 and 9. In the front end detection process, it is detected that the differential value of the amount of displacement of the displacement sensor 101 provided in the separation flapper 10 exceeds a threshold, so as to detect the front end of the sheet 1. The amount of displacement of the displacement sensor 101 is acquired as a pulse count value.

Figure 7A:
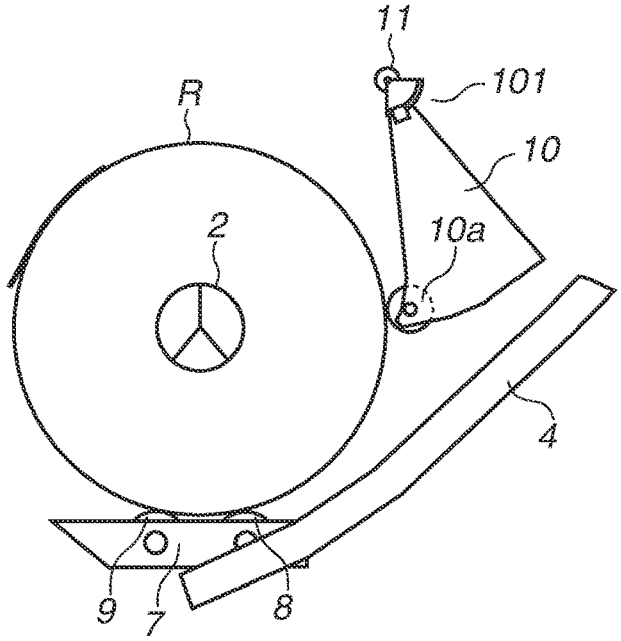
FIGS. 7A, 7B, and 7C are diagrams each illustrating a state of a separation flapper according to a position of a front end of the sheet.
Figure 7B:
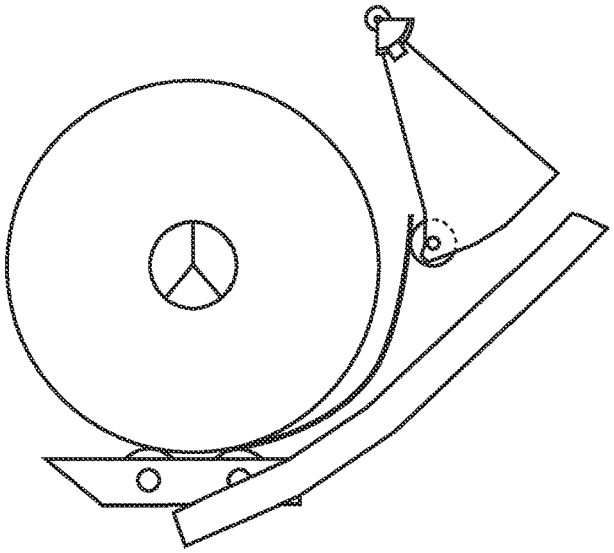
Figure 7C:
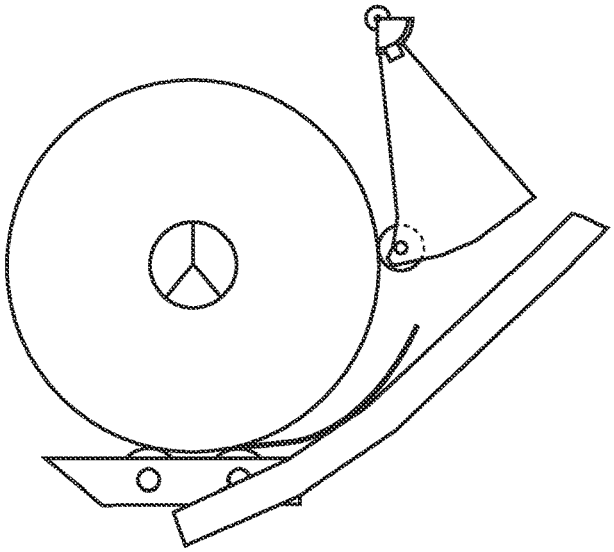
Figure 8:
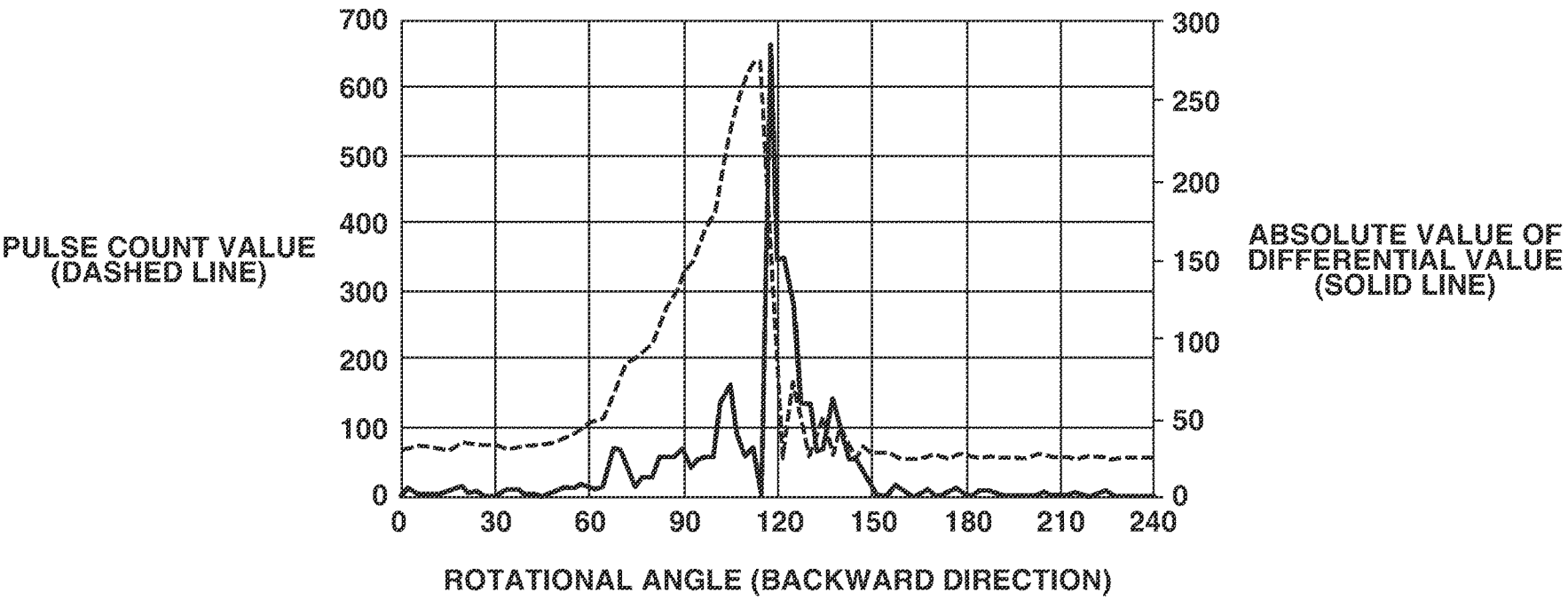
FIG. 8 is a graph of a pulse count value and a differential value of the separation flapper when a roll sheet is rotated backward.

FIGS. 7A, 7B, and 7C illustrate the states of the front end of the sheet 1 and the separation flapper 10 in a case where the stiffness of the roll sheet R is high. FIG. 8 illustrates a graph of the pulse count value (a dashed line) as the amount of displacement of the displacement sensor 101 and the differential value (a solid line) of the amount of displacement of the displacement sensor 101 in a case where the roll sheet R is rotated in the backward direction. In the state where the separation flapper 10 is in contact with the surface of the roll sheet R, the roll sheet R is rotated in the backward direction. The rotational angle of the roll sheet R at this position is 0 degrees (FIG. 7A). From when the rotation in the backward direction is started to when the rotational angle becomes 60 degrees, the driven roller 10*a* of the separation flapper 10 is in contact with the surface of the roll sheet R, and the pulse count value of the displacement sensor 101 is within a certain range. The roll sheet R further rotates, and around the time when the rotational angle exceeds 60 degrees, the pulse count value of the displacement sensor 101 starts to increase. This is because the front end of the sheet 1 in the roll sheet R pushes the separation flapper 10, and the separation flapper 10 rotates about the separation flapper rotating shaft 11.

Immediately before the front end of the sheet 1 passes through the driven roller 10*a*, the amount of displacement of the separation flapper 10 comes to its maximum (FIG. 7B). When the roll sheet R further rotates and the rotational angle is from 115 degrees to 120 degrees, the pulse count value greatly decreases. This is because the front end of the sheet 1 falls onto the arm member 4 as a result of the front end of the sheet 1 passing through the driven roller 10*a* of the separation flapper 10. Accordingly, the separation flapper 10 pushed by the sheet 1 comes into contact with the surface of the roll sheet R that is not loosely wound (FIG. 7C). At this time, the absolute value of the differential value of the amount of displacement of the separation flapper 10 comes to its maximum. Also in the case of plain paper having low stiffness, the pulse count value is changed as a result of the front end of the sheet 1 passing through the driven roller 10*a* of the separation flapper 10. The front end of the sheet 1 can be detected based on the differential value of the amount of displacement of the separation flapper 10. A first threshold for detecting the front end of the sheet 1 is 100, for example. The first threshold is saved in advance in the ROM 204.

Figure 9:
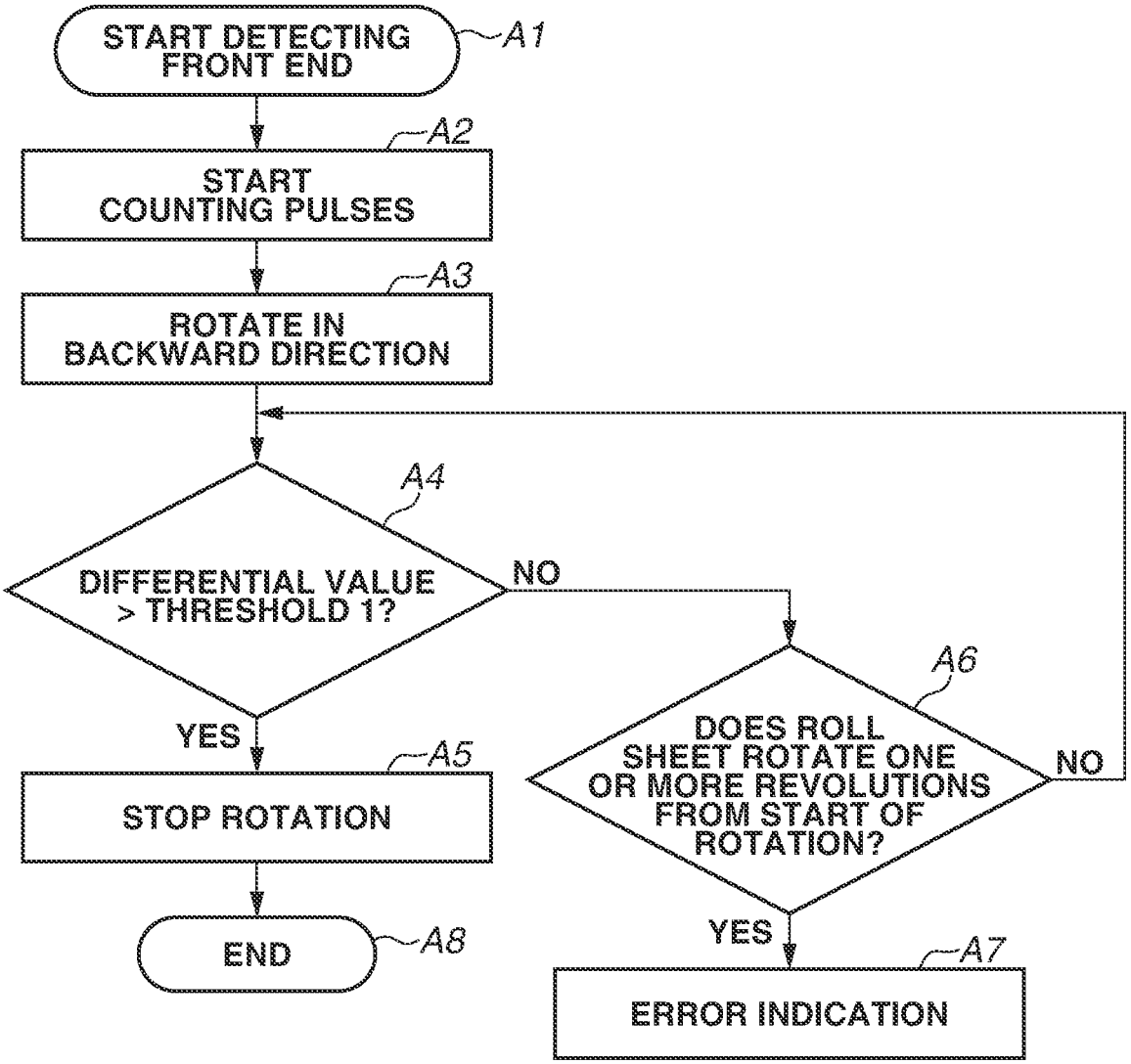
FIG. 9 is a flowchart of detection of the front end of the sheet in the roll sheet.

A flowchart of the front end detection using this principle is to be described with reference to FIG. 9.

In step A1, the front end detection is started. In this state, the spool member 2 is set.

In step A2, the counting of the pulses of the displacement sensor 101 is started. Every time a certain time elapses, the pulse count value is acquired and sequentially saved in the RAM 203 as a temporary storage area. The rotational angle of the roll sheet R corresponding to the pulse count value is sequentially saved in association with the pulse count value. In this case, after the pulse count value is reset, the counting of the pulses is started. The initial value of the pulse count value may be saved, and a relative value may be used.

In step A3, the roll sheet R is rotated in the backward direction. The control unit 201 rotates the roll sheet R in the backward direction while acquiring the pulse count value of the displacement sensor 101 and the rotational angle of the roll sheet R. An indication that the front end detection is started is displayed on a display unit of the operation panel 28 via the input/output interface 202, where necessary.

In step A4, it is determined whether the differential value of the amount of displacement exceeds the first threshold (threshold 1). From the saved pulse count value and rotational angle, the differential value (a difference value because the differential value is a digital value) of the pulse count value corresponding to the rotational angle and the absolute value of the differential value are calculated. If the absolute value of the differential value of the pulse count value exceeds the first threshold (threshold 1) (Yes in step A4), it can be determined that the front end of the sheet 1 is detected. The front end of the sheet 1 can be more accurately detected if the front end of the sheet 1 is detected from the time when the absolute value of the differential value exceeds the first threshold to the time when the absolute value of the differential value is less than or equal to the first threshold. Although the absolute value of the differential value is used, the normal differential value may be used. In this case, thresholds are set as both positive and negative values.

In step A5, the rotation of the roll sheet R is stopped. If the absolute value of the differential value exceeds the first threshold (Yes in step A4), the control unit 201 rotates the roll sheet R by a predetermined amount in the backward direction and stops the rotation of the roll sheet R. As a result, the front end of the sheet 1 in the roll sheet R is located on the arm member 4 between the separation flapper 10 and the pressure contact roller 8. That is, if the roll sheet R is rotated in the forward direction, the front end of the sheet 1 can be supplied to the supply path.

In step A6, it is determined whether the roll sheet R rotates one or more revolutions. If the roll sheet R rotates one or more revolutions (Yes in step A6) and the absolute value of the differential value of the amount of displacement does not exceed the first threshold, it is determined that the front end of the sheet 1 from the roll sheet R is not detected. In this case, the rotation of the roll sheet R is stopped, and the processing proceeds to step A7. In step A7, an error indication that the front end of the sheet 1 is not detected is displayed on a display unit of an operation unit.

In step A8, the front end detection ends.

As described above, the front end of the sheet in the roll sheet can be detected, using the differential value of the displacement of the displacement sensor 101 of the separation flapper 10.

(Sheet Supply Process)

The sheet supply process (step S4) in the automatic loading is to be described in detail with reference to FIGS. 10A, 10B, 11 and 12. In this process, an abnormal state where the supply of the sheet 1 has failed can be detected based on the amount of displacement of the displacement sensor 101 when the sheet 1 is to be supplied.

Figure 10A:
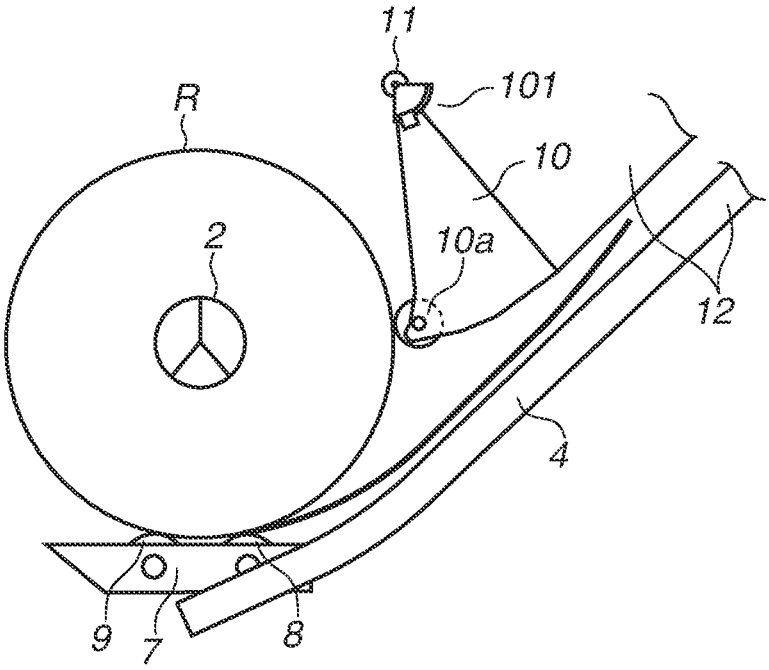
FIGS. 10A and 10B are diagrams illustrating a state where the sheet is normally supplied and a state where the supply of the sheet is abnormal, respectively.
Figure 10B:
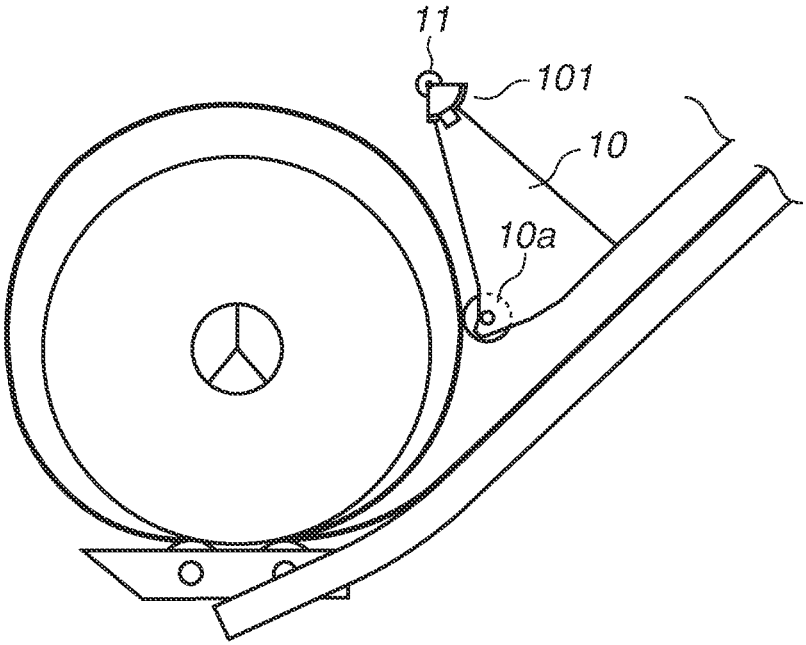
Figure 11:
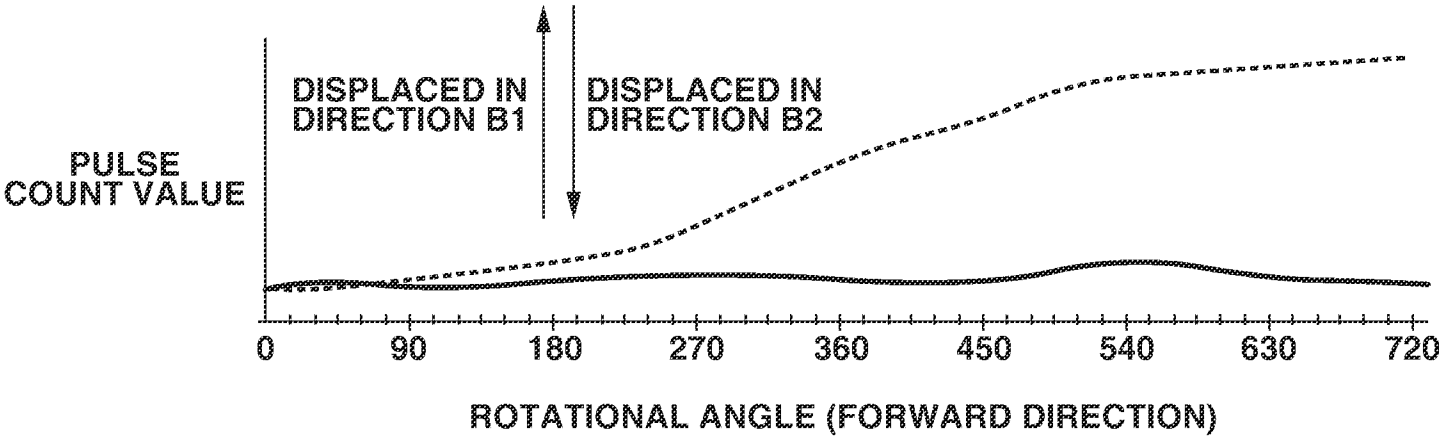
FIG. 11 is a diagram illustrating the pulse count value of the separation flapper in the state where the sheet is normally supplied and the state where the supply of the sheet is abnormal.

FIG. 10A illustrates the state where the sheet 1 is normally supplied. FIG. 10B illustrates the roll sheet R in the state where the sheet 1 is not normally supplied. FIG. 11 illustrates the pulse count value as the amount of displacement of the displacement sensor 101 corresponding to the rotational angle of the roll sheet R. If the sheet 1 is normally supplied from the roll sheet R held in the holding unit, the separation flapper 10 follows the surface of the roll sheet R (FIG. 10A). As a result, the pulse count value of the displacement sensor 101 changes in a certain range (a solid line in FIG. 11). This change occurs due to the deformation of the roll sheet R or the eccentricity or distortion of the roll sheet R in a wound state. As the sheet is pulled out of the roll sheet R, the outer diameter of the roll sheet R becomes smaller. For this reason, the pulse count value gradually decreases.

If the stiffness of the roll sheet R is high, friction on the conveying unit 300 may be greater than a frictional force generated by the pressure contact roller 9. In this case, the sheet 1 jams in the middle of the conveying unit 300, and the roll sheet R is gradually loosened (FIG. 10B). At this time, if the separation flapper 10 is pushed by the loosely wound sheet 1, the pulse count value of the displacement sensor 101 gradually increases as indicated by a dashed line (a dotted line in FIG. 11). When a change in the pulse count value exceeds a second threshold (a threshold 2) after the supply of the sheet 1 is started, it can be determined that the supply of the sheet 1 is in an abnormal state. The second threshold is saved in advance in the ROM 204. The second threshold is, for example, 200, based on the maximum amount of eccentricity corresponding to a maximum radius of 90 mm of the roll sheet R. The threshold may be changed depending on the outer diameter of the roll sheet R.

A flowchart for detecting an abnormal state of the sheet when the sheet is to be supplied from the roll sheet is to be described based on this principle.

In step B1, the supply of the sheet 1 from the roll sheet R is started. In this state, the sheet 1 is supplied by the pressing force in the weak nip state. This is to prevent unnecessary pressure from being applied to a medium such as plain paper, coated paper, or thin glossy paper.

In step B2, the counting of the pulses of the displacement sensor 101 is started. Every time a certain time elapses, the pulse count value is sequentially saved in the RAM 203 as a temporary storage area. The rotational angle of the roll sheet R is sequentially saved together with the pulse count value. After the pulse count value is reset, the counting of the pulses is started.

In step B3, the roll sheet R is rotated in the forward direction. When the roll sheet R is rotated in the forward direction, the sheet 1 is supplied to the conveying unit 300 through the supply path.

In step B4, it is determined whether the pulse count value of the displacement sensor 101 exceeds the second threshold. If the pulse count value of the displacement sensor 101 does not exceed the second threshold (No in step B4), the sheet 1 is in a normal supply state, and the processing proceeds to step B5. If the pulse count value exceeds the second threshold (Yes in step B4), then as described above, an abnormality is occurring when the sheet 1 is supplied.

In step B5, it is determined whether the sheet 1 reaches the edge detection sensor 16. While rotating the roll sheet R in the forward direction, the control unit 201 determines whether the sheet 1 has reached the edge detection sensor 16. If the sheet 1 has reached the edge detection sensor 16 (Yes in step B5), it can be determined that the supply of the sheet 1 normally ends.

In step B6, the conveying roller 14 is caused to nip the sheet 1. First, if the edge detection sensor 16 detects the front end of the sheet 1, the control unit 201 further supplies the sheet 1 by a predetermined amount. At this time, the control unit 201 rotates the conveying roller 14 in the forward direction and causes the conveying roller 14 and the pinch roller 15 to nip the front end of the sheet 1. Then, the control unit 201 stops the rotation of the roll sheet R in the forward direction and the rotation of the conveying roller 14 in the forward direction. The control unit 201 separates the first and second pressure contact rollers 8 and 9 from the roll sheet R and releases the pressing force. This can eliminate the influence of the pressure contact rollers 8 and 9 on the accuracy of the correction of skew and the print accuracy of an image.

In step B7, the roll sheet R is rotated in the backward direction. If it is determined that the supply state of the sheet 1 is abnormal, the control unit 201 stops the rotation of the roll sheet R in the forward direction and rotates the roll sheet R in the backward direction. The amount of rotation in the backward direction is an amount of rotation corresponding to two more revolutions of the roll sheet R in addition to the amount of rotation by which the sheet 1 is supplied. This is to return the front end of the sheet 1 in the roll sheet R to the initial state and also tightly wind the roll sheet R.

In step B8, it is determined whether the sheet 1 is a resupplied sheet. The "resupplied sheet" is a sheet of which the first supply has failed and the resupply is attempted. If the sheet 1 is a resupplied sheet (Yes in step B8), it is less likely that the sheet 1 can be successfully supplied even if the sheet supply operation is performed again. Accordingly, the processing proceeds to step B11. In step B11, an error indication that the supply of the sheet 1 has failed is displayed on the display unit of the operation unit.

In step B9, it is determined whether the pulse count value of the displacement sensor 101 is smaller than a first allowable value (allowable value 1). If the sheet 1 is not a resupplied sheet (No in step B8), the state of the roll sheet R is confirmed to supply the sheet 1 again. If the pulse count value is smaller than the first allowable value (allowable value 1) in the state where the roll sheet R is wound back (Yes in step B9), it can be determined that the roll sheet R returns to the initial state, including loosening of winding. The first allowable value is set, taking into account the eccentricity of the roll sheet R or the deformation of the roll sheet R. Since the rotational angle of the roll sheet R is returned to that when the rotation is started, the influence of the eccentricity can be ignored. Thus, the first allowable value is set to 30, for example.

If the pulse count value is greater than or equal to the first allowable value in step B9 (No in step B9), it is considered that the loosening of the winding is not removed. Accordingly, the processing proceeds to step B11. In step B11, an error indication that an abnormality has occurred in the winding back of the roll sheet R is displayed on the display unit of the operation panel 28.

In step B10, the pressing force is changed. The pressing force of the arm member 4 is changed to the pressing force in the strong nip state to supply the sheet 1 again. If the nip force of the pressure contact roller 9 is made stronger than sheet friction on the conveying path, it is highly likely that the supply of the sheet 1 is successful even in the case of using fine art paper having high stiffness. Then, the processing proceeds to step B2, and in step B2, the sheet 1 is resupplied.

In this manner, when a sheet is supplied, an abnormal state of the sheet can be detected. If the abnormal state is detected, the sheet can be supplied again by changing a pressing force after the loosening of the winding of the sheet is removed.

As described above, the displacement sensor 101 of the separation flapper 10 monitors the state of the roll sheet, whereby it is possible to normally automatically supply a sheet.

In a second exemplary embodiment, another configuration of the displacement sensor that detects the displacement of the separation flapper is to be described. Other components are similar to those in the first exemplary embodiment, and therefore are not described here.

Figure 13A:
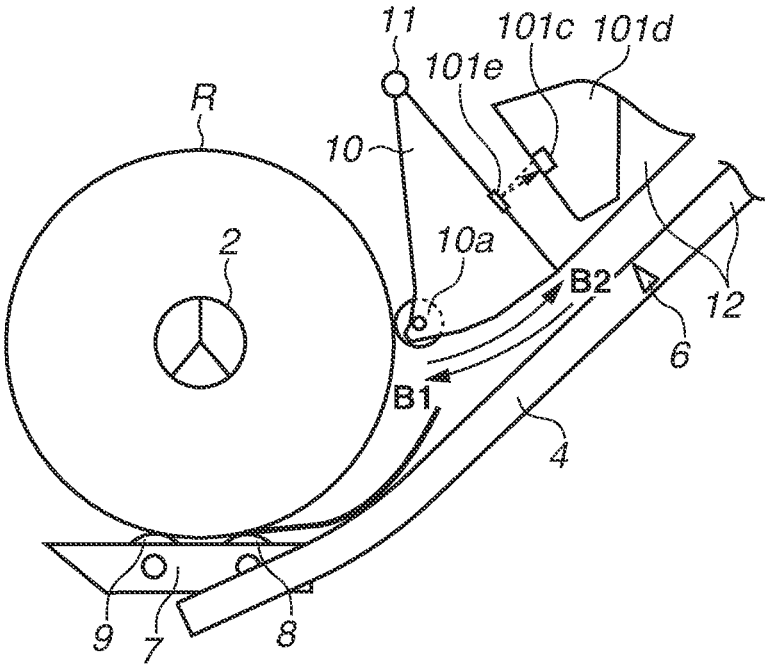
FIGS. 13A and 13B are diagrams each illustrating a displacement sensor according to a second exemplary embodiment.

FIG. 13A illustrates a configuration in which an optical sensor is used as a displacement sensor. An optical sensor 101*c* is provided in a sensor holder 101*d*, and the sensor holder 101*d* is provided in an upper portion of the conveying guide 12. The sensor holder 101*d* may not be provided in the conveying guide 12 so long as the sensor holder 101*d* is in a portion that does not move in the housing of the sheet supply device 200. A reflective plate 101*e* is provided at a position in the separation flapper 10 opposed to the optical sensor 101*c*. The optical sensor 101*c* includes a light-emitting unit and a light-receiving unit. The light-emitting unit emits light, and the light-receiving unit receives the light reflected from the reflective plate 101*e*. Since the optical sensor 101*c* receives light reflected from the reflective plate 101*e*, the output of the optical sensor 101*c* changes depending on the position of the separation flapper 10. That is, if the separation flapper 10 moves in the direction B1, the output value of the optical sensor 101*c* decreases. If the separation flapper 10 moves in the direction B2, the output value of the optical sensor 101*c* increases. There is a correlation between the amount of displacement of the separation flapper 10 and the output value of the optical sensor 101*c*. For this reason, the optical sensor 101*c* can detect the amount of displacement of the separation flapper 10. Instead of the optical sensor, a capacitive sensor or an ultrasonic sensor can be used as a distance sensor.

Figure 13B:
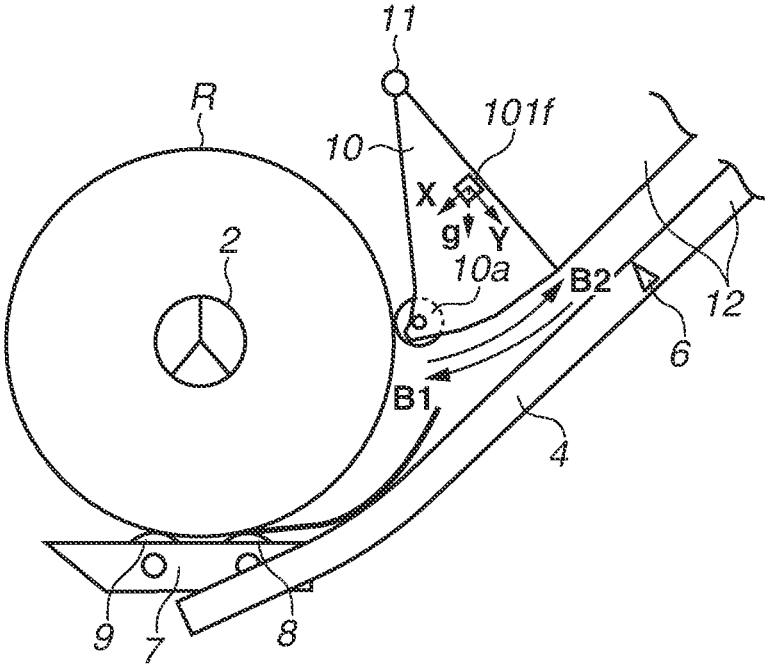

FIG. 13B illustrates a configuration in which an acceleration sensor is used as a displacement sensor. An acceleration sensor 101*f* is provided in the separation flapper 10. The acceleration sensor 101*f* measures accelerations in the X-direction and the Y-direction based on coordinates on the separation flapper 10. The acceleration sensor 101*f* is subjected to the force of gravity. For this reason, if the separation flapper 10 is displaced, component forces in the X-direction and the Y-direction change. That is, if the separation flapper 10 is displaced in the direction B1, the output value in the X-direction becomes small, and the output value in the Y-direction becomes great. Conversely, if the separation flapper 10 is displaced in the direction B2, the output value in the X-direction becomes great, and the output value in the Y-direction becomes small. The amount of displacement of the separation flapper 10 correlates with each of the output value in the X-direction and the output value in the Y-direction. Accordingly, the acceleration sensor 101*f* can detect the amount of displacement of the separation flapper 10.

A sheet detection sensor 6 may be provided in the arm member 4. The sheet detection sensor 6 can be used instead of the edge detection sensor 16. In other words, an abnormal state of the sheet can be detected at the initial stage where the sheet is supplied.

As described above, the amount of displacement of the separation flapper can be detected.

Figure 14:
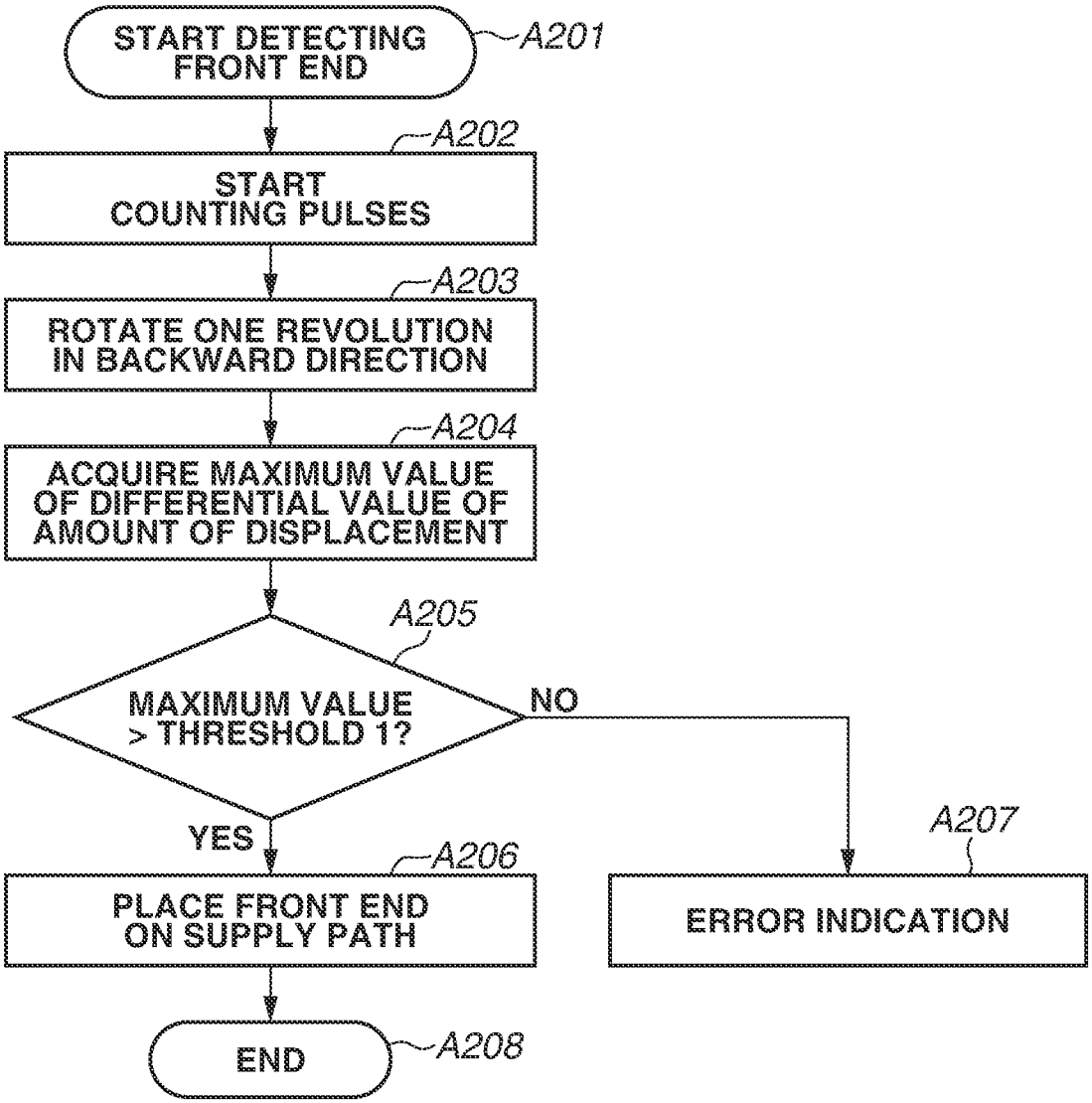
FIG. 14 is a flowchart of a front end detection operation according to a third exemplary embodiment.

In a third exemplary embodiment, another form of the front end detection process (step S3) in the automatic loading of the sheet is to be described. Other components are similar to those in the first exemplary embodiment, and therefore are not described here. In the third exemplary embodiment, also in the cases of various roll sheets having different characteristics, it is possible to stably detect the front end of the sheet 1 in the roll sheet R. That is, in a case where a roll sheet has high stiffness, even in a case of a portion other than the front end of a sheet, the displacement of the separation flapper 10 may be greater than or equal to a threshold. The characteristic that the differential value of the displacement of the separation flapper 10 comes to its maximum at the front end of the sheet 1 is used. FIG. 14 illustrates a flowchart of the front end detection process according to the third exemplary embodiment.

In step A201, the front end detection operation is started. In this state, the spool member 2 is set.

In step A202, the counting of the pulses of the displacement sensor 101 is started. Every time a certain time elapses, the pulse count value is acquired and sequentially saved in the RAM 203 as a temporary storage area. The rotational angle of the roll sheet R corresponding to the pulse count value is sequentially saved in association with the pulse count value.

In step A203, the roll sheet R is rotated one revolution in the backward direction. The control unit 201 rotates the roll sheet R one revolution in the backward direction and stops the rotation of the roll sheet R. Although the roll sheet R is rotated one revolution, the roll sheet R may be rotated two or more revolutions. If the roll sheet R is rotated two or more revolutions, the pulse count value and the rotational angle of the roll sheet R at the last revolution are used.

In step A204, the maximum value of the differential value of the displacement is searched for. The control unit 201 calculates the differential value (a difference value in this case) of the pulse count value per unit angle based on the pulse count value and the rotational angle of the roll sheet R saved in the RAM 203. The control unit 201 searches for the maximum value of the absolute value of the calculated differential value, and identifies the rotational angle (φ) of the roll sheet R at this time.

In step A205, it is determined whether the maximum value exceeds a first threshold. The first threshold is a value set in advance in the ROM 204. If the maximum value of the differential value exceeds the first threshold (Yes in step A205), it can be determined that the front end of the sheet 1 is detected. The rotational angle φ of the roll sheet R at this time is the front end of the sheet 1. If, on the other hand, the maximum value is less than or equal to the first threshold (No in step A205), the maximum value may be external noise such as a vibration. In this case, the processing proceeds to step A207. In step A207, an error indication that the front end is not detected is displayed on the display unit of the operation unit.

In step A206, the front end of the sheet 1 is placed on the supply path. The control unit 201 rotates the roll sheet R by the rotational angle φ. This results in the state where the front end of the sheet 1 can be supplied from the roll sheet R to the supply path.

In step A207, the front end detection ends.

As described above, the front end of the sheet from the roll sheet can be detected based on the differential value of the amount of displacement of the displacement sensor 101 of the separation flapper 10.

In a fourth exemplary embodiment, another form of the sheet supply process (step S4) in the automatic loading of the sheet is to be described. Other components are similar to those in the first exemplary embodiment, and therefore are not described here. In the present exemplary embodiment, if the supply of the sheet has failed, it is possible to detect that the front end of the sheet is folded.

Figure 15:
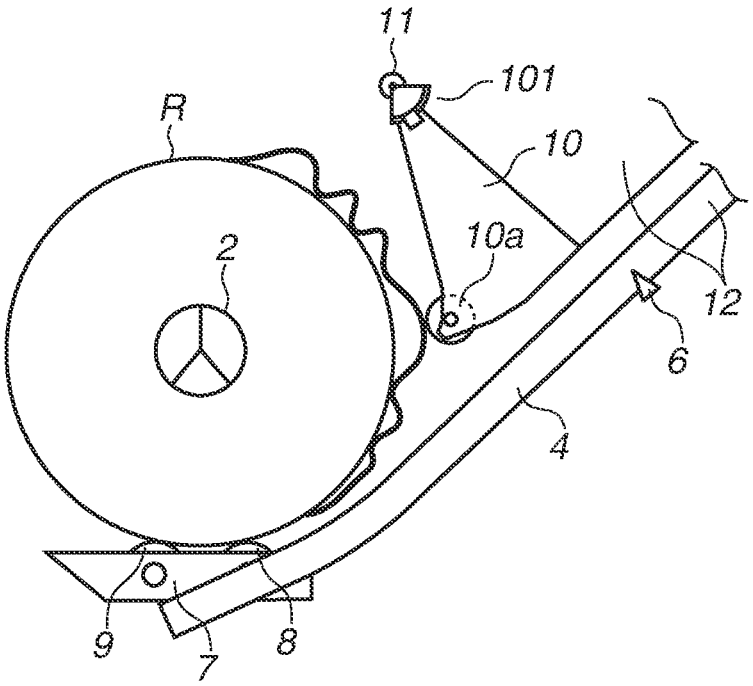
FIG. 15 is a diagram illustrating a state where a sheet is folded.
Figure 16:
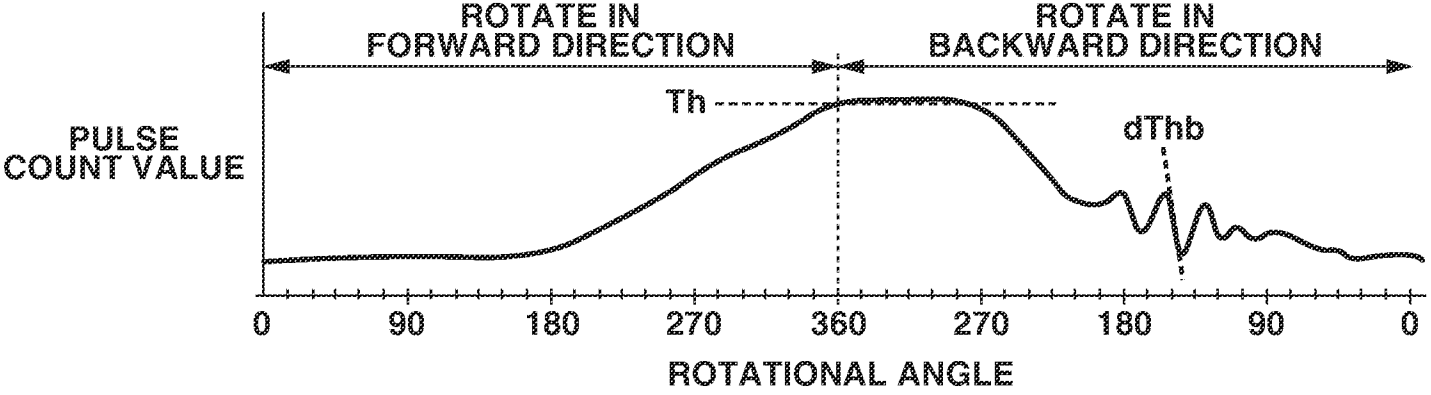
FIG. 16 is a graph illustrating a waveform in a case where the sheet is folded.

Examples of the reason why the sheet is folded include a case where the sheet is folded from the start, and a case where the sheet to be supplied cannot be supplied and becomes folded. Even if the sheet is wound back in these cases, the state where the sheet is folded may not be remedied. Thus, even if the sheet is to be supplied again, the supply of the sheet fails. FIG. 15 illustrates a situation where the supply of the sheet has failed and the sheet is folded. FIG. 16 illustrates the pulse count value of the displacement sensor in a case where the supply of the sheet has failed and the sheet is further wound back.

Around the time when the amount of rotation of the roll sheet R exceeds 180 degrees after the supply of the sheet 1 is started, the pulse count value starts to increase because the winding of the roll sheet R is loosened due to the jam of the sheet 1. Around the time when the roll sheet R rotates one revolution, the pulse count value exceeds a first threshold (Th) for determining the failure of the supply of the sheet 1, and the rotation of the roll sheet R in the forward direction is stopped. In this state, in addition to the loosening of the winding of the sheet 1, the sheet 1 may be folded (FIG. 15). After this, the sheet 1 is wound back by rotating the roll sheet R in the backward direction. Around the time when the rotational angle of the roll sheet R exceeds 270 degrees, the loosening of the winding is removed, and the pulse count value starts to decrease. When the sheet 1 is further wound back and the rotational angle is near 180 degrees, the pulse count value increases or decreases. As a result, the absolute value of the differential value (a difference value in this case) per unit angle may exceed a second allowable value (dThb). If it is detected that the absolute value of the differential value exceeds the second allowable value, it is possible to detect that the sheet 1 is folded. If the sheet 1 is not folded, the pulse count value monotonically decreases.

Figure 17:
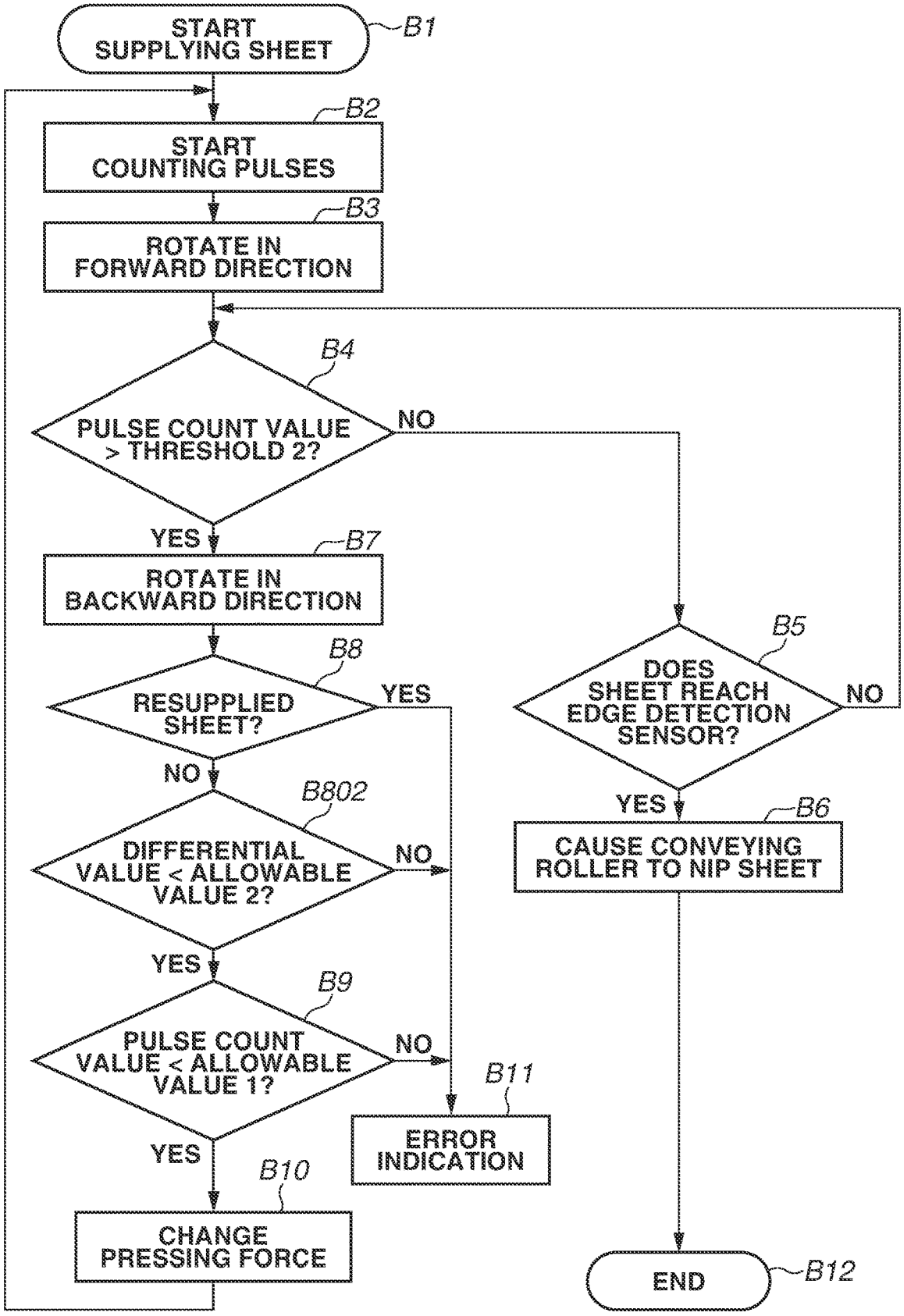
FIG. 17 is a flowchart of supply of a sheet according to a fourth exemplary embodiment.

FIG. 17 illustrates a flowchart of the sheet supply process based on this principle. The flowchart is obtained by adding step B802 between steps B8 and B9 in FIG. 12. The added part is described below.

In step B7, the roll sheet R is rotated in the backward direction. If it is determined that the supply state of the sheet 1 is abnormal, the control unit 201 stops the rotation of the roll sheet R in the forward direction and rotates the roll sheet R in the backward direction. The amount of rotation in the backward direction is an amount of rotation corresponding to two more revolutions in addition to the amount of rotation by which the sheet 1 is supplied. This is to return the front end of the sheet 1 in the roll sheet R to the initial state and also tightly wind the roll sheet R. At this time, every time a certain time elapses, the pulse count value as the amount of displacement is acquired and sequentially saved in the RAM 203 as a temporary storage area. Further, the rotational angle of the roll sheet R is sequentially saved together with the pulse count value.

In step B8, it is determined whether the sheet 1 is a resupplied sheet. If the sheet 1 is a resupplied sheet (Yes in step B8), it is less likely that the sheet 1 can be supplied even if the sheet supply operation is performed again. Accordingly, the processing proceeds to step B11. In step B11, an error indication that the sheet 1 is not supplied is displayed on the display unit of the operation unit.

In step B802, it is determined whether the differential value is smaller than the second allowable value. The acquired amount of displacement is differentiated. If the maximum value of the differential value is smaller than the second allowable value (Yes in step B802), it can be determined that the sheet 1 is not folded. If it is determined that the sheet 1 is folded, the processing proceeds to step B11. In step B11, an error indication that the sheet 1 is folded is displayed on the display unit of the operation panel 28.

In step B9, it is determined whether the pulse count value is smaller than a first allowable value (an allowable value 1). If the sheet 1 is not a resupplied sheet (No in step B8), the state of the roll sheet R is confirmed to supply the sheet 1 again. If the pulse count value is smaller than the first allowable value (allowance value 1) (Yes in step B9), it can be determined that the roll sheet R returns to the initial state, including loosening of winding.

If the pulse count value is greater than or equal to the first allowable value in step B9 (No in step B9), it is considered that the loosening of the winding is not removed. Accordingly, the processing proceeds to step B11. In step B11, an error indication that an abnormality has occurred in the roll sheet R is displayed on the display unit of the operation panel 28.

In step B10, the pressing force is changed. The pressing force of the arm member 4 is changed to the pressing force in the strong nip state to supply the sheet 1 again. If the nip force of the pressure contact roller 9 is made stronger than sheet friction on the conveying path, it is highly likely that the supply of the sheet 1 is successful even in a case where fine art paper having high stiffness is used. Then, the processing proceeds to step B2.

As described above, an abnormal state of the sheet can be detected based on the amount of displacement of the displacement sensor 101 of the separation flapper 10, when the sheet is to be supplied. If the abnormal state is detected, it can be determined whether the sheet is folded. If the sheet is not folded, the sheet is supplied again.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-203276, filed Oct. 29, 2018, which is hereby incorporated by reference herein in its entirety.

What is claimed is:

1. A print apparatus comprising:

a holding unit configured to hold a roll sheet obtained by winding a sheet;

a driving unit configured to rotate the roll sheet held by the holding unit;

a separation flapper configured to follow a surface of the roll sheet to separate the sheet from the roll sheet;

a pressure contact roller configured to come into pressure contact with the roll sheet surface;

a print unit configured to print an image on the sheet supplied by rotating the roll sheet in pressure contact with the pressure contact roller in a forward direction;

a displacement sensor configured to detect an amount of displacement of the separation flapper according to rotation of the separation flapper; and a control unit configured to stop the roll sheet rotation in a case where the displacement amount detected by the displacement sensor exceeds a threshold while the roll sheet is being rotated in the forward direction after a front end of the roll sheet is detected.

2. The print apparatus according to claim 1, wherein the control unit further rotates the roll sheet by a predetermined amount in a backward direction after the control unit stops the roll sheet rotation.

3. The print apparatus according to claim 2, wherein, in a case where, when the control unit rotates the roll sheet by the predetermined amount and stops the roll sheet rotation, the separation flapper displacement amount is smaller than a first allowable value, the control unit further changes a pressing force of the pressure contact roller and rotates the roll sheet in the forward direction.

4. The print apparatus according to claim 2, wherein, in a case where, when the control unit rotates the roll sheet by the predetermined amount, a differential value of the separation flapper displacement amount corresponding to a rotational angle of the roll sheet is smaller than a second allowable value, the control unit further changes a pressing force of the pressure contact roller and rotates the roll sheet in the forward direction.

5. The print apparatus according to claim 1, wherein the displacement sensor is an encoder or an acceleration sensor provided in the separation flapper.

6. The print apparatus according to claim 1, wherein the displacement sensor is any one of an optical sensor, a capacitance sensor, and an ultrasonic sensor provided in a housing of the print apparatus.

7. A method for a print apparatus having a separation flapper, a pressure contact roller, a print unit, and a displacement sensor, the method comprising:

holding a roll sheet obtained by winding a sheet;

rotating the held roll sheet;

following a surface of the roll sheet and separating the sheet from the roll sheet via the separation flapper;

coming into pressure contact with the roll sheet surface via the pressure contact roller;

printing, via the print unit, an image on the sheet supplied by rotating the roll sheet in pressure contact with the pressure contact roller in a forward direction;

detecting, via displacement sensor, an amount of displacement of the separation flapper according to rotation of the separation flapper; and stopping the roll sheet rotation in a case where the displacement amount detected by the displacement sensor exceeds a threshold while the roll sheet is being rotated in the forward direction after a front end of the roll sheet is detected.

8. The method according to claim 7, wherein stopping includes further rotating the roll sheet by a predetermined amount in a backward direction after the roll sheet rotation is stopped.

9. The method according to claim 8, wherein, in a case where, when the roll sheet is rotated by the predetermined amount and the rotation of the roll sheet is stopped, the separation flapper displacement amount is smaller than a first allowable value, stopping includes further changing a pressing force of the pressure contact roller and rotating the roll sheet in the forward direction.

10. The method according to claim 8, wherein, in a case where, when the roll sheet is rotated by the predetermined amount, a differential value of the separation flapper displacement amount corresponding to a rotational angle of the roll sheet is smaller than a second allowable value, stopping includes further changing a pressing force of the pressure contact roller and rotates the roll sheet in the forward direction.

11. The method according to claim 7, further comprising providing an encoder or an acceleration sensor as the displacement sensor in the separation flapper.

12. The method according to claim 7, further comprising providing as the displacement sensor in a housing of the print apparatus, any one of an optical sensor, a capacitance sensor, and an ultrasonic sensor.

13. A non-transitory computer-readable storage medium storing a program to cause a computer to perform a method for a print apparatus having a separation flapper, a pressure contact roller, a print unit, and a displacement sensor, the method comprising:

holding a roll sheet obtained by winding a sheet;

rotating the held roll sheet;

following a surface of the roll sheet and separating the sheet from the roll sheet via the separation flapper;

coming into pressure contact with the roll sheet surface via the pressure contact roller;

printing, via the print unit, an image on the sheet supplied by rotating the roll sheet in pressure contact with the pressure contact roller in a forward direction;

detecting, via displacement sensor, an amount of displacement of the separation flapper according to rotation of the separation flapper; and stopping the roll sheet rotation in a case where the displacement amount detected by the displacement sensor exceeds a threshold while the roll sheet is being rotated in the forward direction after a front end of the roll sheet is detected.

* * * * *